US010741147B1

(12) United States Patent
Chen

(10) Patent No.: US 10,741,147 B1
(45) Date of Patent: Aug. 11, 2020

(54) DRIVING DISPLAY DEVICE WITH VOLTAGE COMPENSATION BASED ON LOAD ESTIMATION

(71) Applicant: Facebook Technologies, LLC, Menlo Park, CA (US)

(72) Inventor: Dong Chen, Suzhou (CN)

(73) Assignee: Facebook Technologies, LLC, Menlo Park, CA (US)

( * ) Notice: Subject to any disclaimer, the term of this patent is extended or adjusted under 35 U.S.C. 154(b) by 119 days.

(21) Appl. No.: 15/940,394

(22) Filed: Mar. 29, 2018

(51) Int. Cl.
*G09G 5/10* (2006.01)

(52) U.S. Cl.
CPC ..... *G09G 5/10* (2013.01); *G09G 2330/023* (2013.01)

(58) Field of Classification Search
CPC ..... G09G 5/10; G09G 2330/023; G09G 2330/021; G09G 2360/16; G09G 3/3208; G09G 3/2088; G09G 5/363; G09G 2320/0204; G09G 2330/02; G09G 2380/10; G06F 1/163; G06F 9/505; G06F 9/5083; G06F 1/3265; G06F 1/3206; G06F 11/3062; G06F 1/26; G06F 2209/5022; G06F 11/3466; G06F 11/3414; H04L 27/2614; G06T 1/20; G06T 1/00
See application file for complete search history.

(56) References Cited

U.S. PATENT DOCUMENTS 9,236,035 B1 * 1/2016 Kim ..... G09G 5/36
2018/0295282 A1 * 10/2018 Boyce ..... H04L 65/4092
2018/0309927 A1 * 10/2018 Tanner ..... H04N 5/23238

* cited by examiner

*Primary Examiner* — Xilin Guo
(74) *Attorney, Agent, or Firm* — Fenwick & West LLP

(57) ABSTRACT

Embodiments relate to estimating power consumption for displaying an image at a display device and sending a load signal indicating expected power consumption for displaying the image to the display device to enable the display device to adjust input voltage at its display integrated circuit (IC). The load signal may be received at a compensation circuit that generates and sends a control signal to a power IC in the display device so that the power IC adjusts its output voltage according to the control signal. In this way, the input voltage at the display IC is maintained relatively constant even when the power consumption changes to display different images.

14 Claims, 4 Drawing Sheets

DRIVING DISPLAY DEVICE WITH VOLTAGE COMPENSATION BASED ON LOAD ESTIMATION

BACKGROUND

Field of Technology

This disclosure relates generally to a head-mounted display (HMD), and more particularly, to compensating for drop of input voltage to the display device based on load for displaying an image on a display device of the HMD.

Discussion of the Related Art

A display device generally experiences different current load based on the images it displays. When high load images (e.g., bright images or static images) are displayed, the display panel and a display integrated circuit (IC) of the display device uses higher current compared to when low load images (e.g., darker images or dynamic images) are displayed. Depending on the current load at the display device, a voltage drop between the display IC and a power IC that provides power to the display IC also changes. The power IC of the display device is generally responsible for sensing the load at the display IC and controlling input current or voltage to the display IC. However, the power IC may not properly sense and adjust its current or voltage output appropriately, leading to flickering of images or displaying of degraded images on the display panel as the load changes.

SUMMARY

Embodiments relate to controlling an input voltage or an input current to a display integrated circuit (IC) based on expected load determined by a graphics processing unit (GPU). The GPU includes an image processing circuit that processes images for display, and a load estimation circuit that receives the processed image and estimates power consumption for displaying the processed image. The load estimation circuit generates and sends a load signal representing power estimated for displaying the processed images. The display device includes a display integrated circuit (IC) that receives the processed image from the GPU and generates signals for driving a display panel, a power IC that controls input voltage to the display IC, and a compensation circuit that receives the load signal from the load estimation circuit and sends a control signal to adjust the input voltage to the display IC to account for a voltage drop between the power IC and the display IC based on the load signal.

The figures depict various embodiments for purposes of illustration only. Alternative embodiments of the structures and methods illustrated herein may be employed without departing from the principles described herein.

DETAILED DESCRIPTION

Embodiments relate to estimating power consumption for displaying an image at a display device and sending a load signal indicating expected power consumption for displaying the image to the display device to enable the display device to adjust input voltage at its display integrated circuit (IC). The load signal may be received at a compensation circuit that generates and sends a control signal to a power IC in the display device so that the power IC adjusts its output voltage according to the control signal. In this way, the input voltage at the display IC is maintained relatively constant even when the power consumption changes to display different images.

Figure 1:
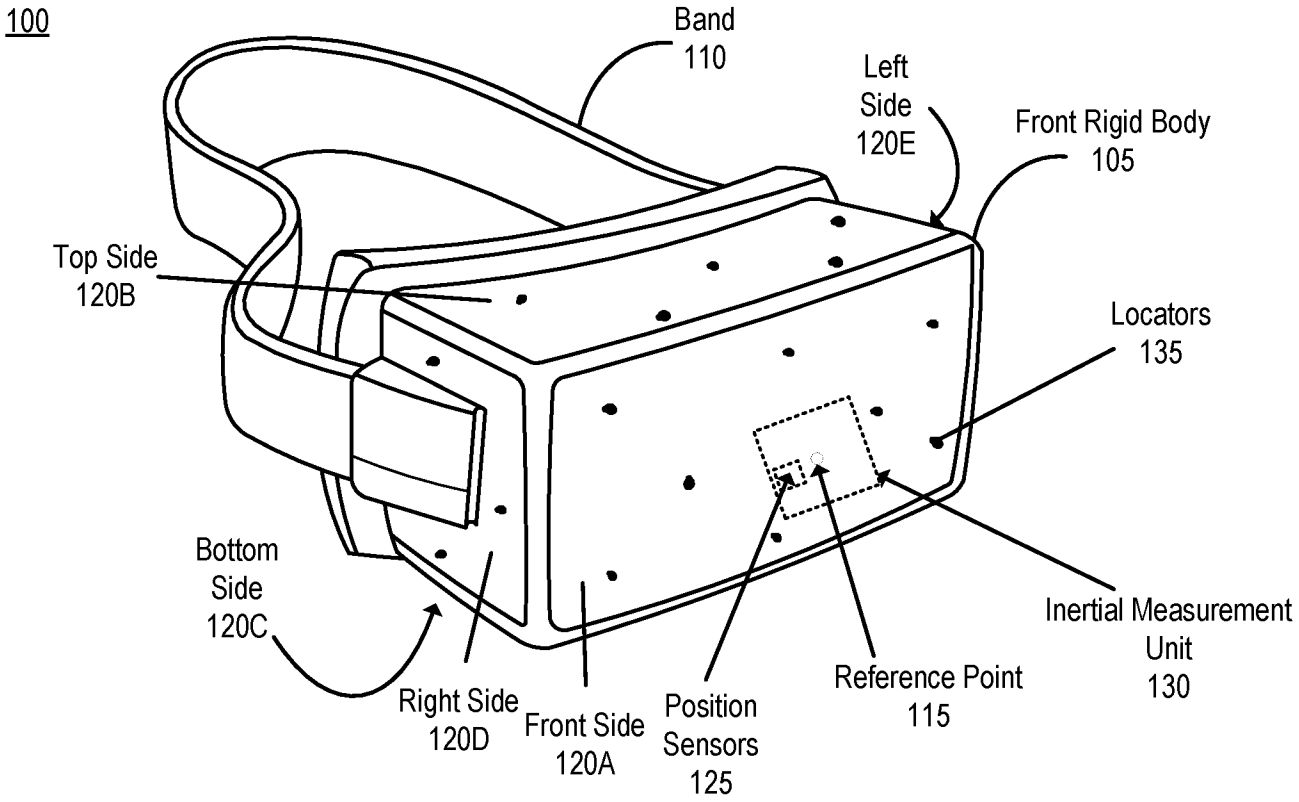
FIG. 1 is a diagram of a head-mounted display (HMD), in accordance with an embodiment.

FIG. 1 is a diagram of a HMD 100, in accordance with an embodiment. The HMD 100 may be a part of an artificial reality system. The HMD 100 includes a front rigid body 105 having a front side 120A, top side 120B, bottom side 120C, right side 120D, and left side 120E, and a band 110. In some embodiments, portions of a front side 120A of the HMD 100 are at least partially transparent in the visible band (~380 nm to 750 nm), and portions of the HMD 100 that are between the front side 120A of the HMD 100 and an eye of the user are at least partially transparent (e.g., a partially transparent electronic display).

The front rigid body 105 includes one or more electronic displays (not shown in FIG. 1), an inertial measurement unit (IMU) 130, one or more position sensors 125, and one or more locators 135. In the embodiment shown by FIG. 1, the position sensors 125 are located within the IMU 130, and neither the IMU 130 nor the position sensors 125 are visible to the user.

The locators 135 may be located in fixed positions on the front rigid body 105 relative to one another and relative to a reference point 115. In the example of FIG. 1, the reference point 115 is located at the center of the IMU 130. Each of the locators 135 may emit light that is detectable by an imaging device (e.g., an imaging device 210 illustrated in FIG. 2, described in greater detail below). In some embodiments, the locators 135 may comprise passive elements (e.g., a retroreflector) that reflect light from a light source that may be detectable by an imaging device. Locators 135, or portions of locators 135, are located on the front side 120A, the top side 120B, the bottom side 120C, the right side 120D, and/or the left side 120E of the front rigid body 105 in the example of FIG. 1. The imaging device may determine a position (includes orientation) of the HMD 100 based upon the detected locations of the locators 135, which may be used to determine the content to be displayed to the user. For example, where the HMD 100 is part of a HMD system, the position of the HMD 100 may be used to determine which virtual objects positioned in different locations are visible to the user of the HMD 100.

Figure 2:
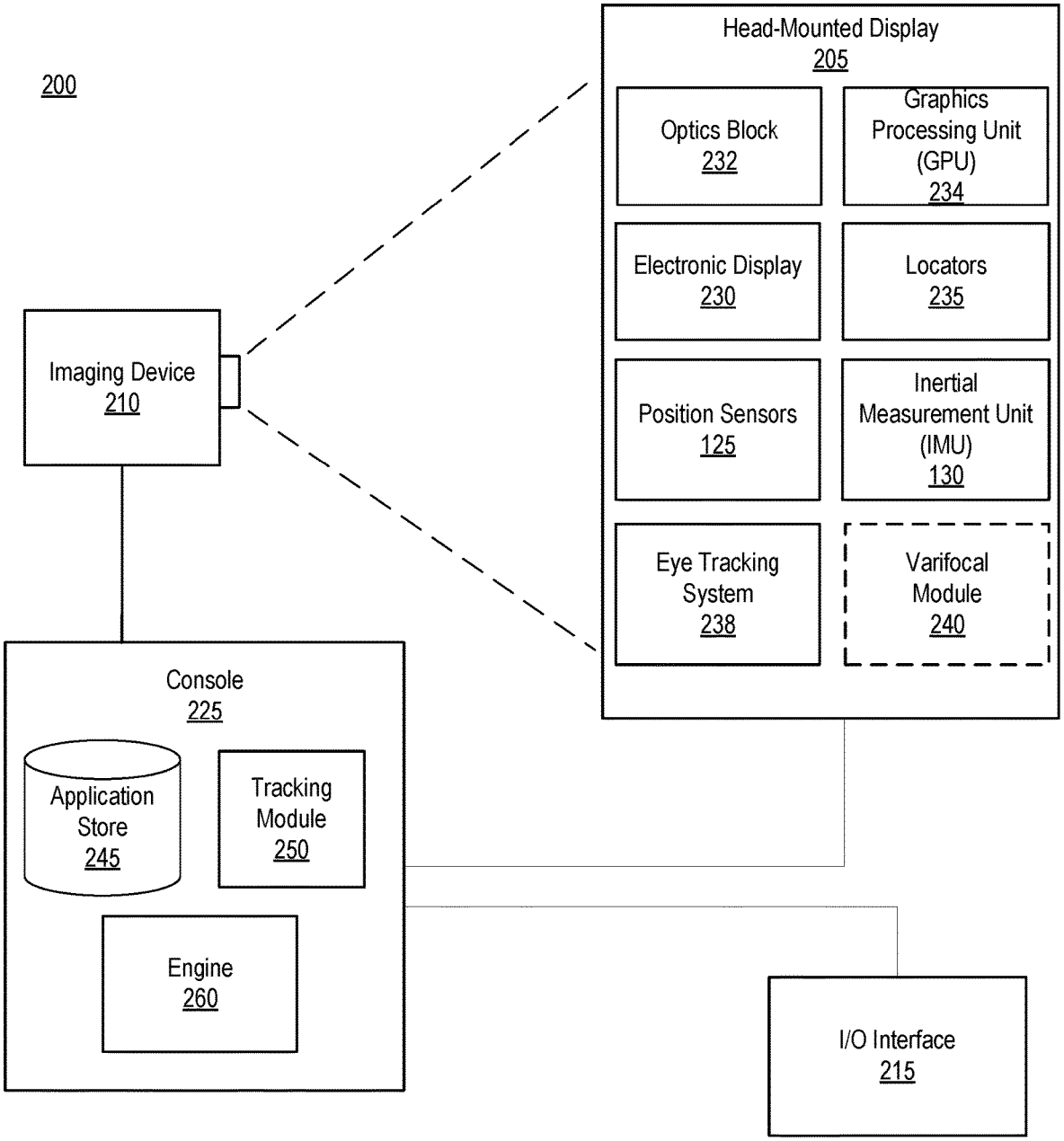
FIG. 2 is a block diagram of a HMD system, in accordance with an embodiment.

FIG. 2 is a HMD system 200 in accordance with an embodiment. The system 200 may be for use as an artificial reality system. In this example, the system 200 includes a HMD 205, an imaging device 210, and an I/O interface 215, which are each coupled to a console 225. While FIG. 2 shows a single HMD 205, a single imaging device 210, and a single I/O interface 215, in other embodiments, any number of these components may be included in the system. For example, there may be multiple HMDs 200 each having an associated I/O interface 215 and being monitored by one or more imaging devices 210, with each HMD 205, I/O interface 215, and imaging devices 210 communicating with the console 225. In alternative configurations, different and/or additional components may also be included in the system 200.

The HMD 205 may act as an artificial reality HMD. In some embodiments, an artificial reality HMD augments views of a physical, real-world environment with computer-generated elements (e.g., images, video, sound, etc.). The HMD 205 presents content to a user. In some embodiments, the HMD 100 is an embodiment of the HMD 205. Example content includes images, video, audio, or some combination thereof. Audio content may be presented via a separate device (e.g., speakers and/or headphones) external to the HMD 205 that receives audio information from the HMD 205, the console 225, or both. The HMD 205 includes an electronic display 230, an optics block 232, one or more locators 235, the position sensors 125, the internal measurement unit (IMU) 130, the eye tracking system 238, and an optional varifocal module 240. The HMD 205 further includes a graphics processing unit (GPU) 234 and a display device (not shown in FIG. 2). Operation of the GPU 234 and the display device is described below with reference to FIG. 3 in detail.

The electronic display 230 displays 2D or 3D images to the user in accordance with data received from the console 225. In various embodiments, the electronic display 230 comprises a single electronic display element or multiple electronic displays (e.g., a display for each eye of a user). Examples of the electronic display element include: a liquid crystal display (LCD), an organic light emitting diode (OLED) display, an inorganic light emitting diode (ILED) display, an active-matrix organic light-emitting diode (AMOLED) display, a transparent organic light emitting diode (TOLED) display, a waveguide display, some other display, or some combination thereof. In some embodiments, the electronic display 230 is driven by a display integrated circuit (IC). The display IC is described below with reference to FIG. 3 in detail.

The optics block 232 magnifies image light received from the electronic display 230, corrects optical errors associated with the image light, and presents the corrected image light to a user of the HMD 205. The optics block 232 includes a plurality of optical elements. Example optical elements included in the optics block 232 include: an aperture, a Fresnel lens, a convex lens, a concave lens, a filter, a reflecting surface, a feature waveguide, or any other suitable optical element that affects image light. Moreover, the optics block 232 may include combinations of different optical elements. In some embodiments, one or more of the optical elements in the optics block 232 may have one or more coatings, such as partially reflective or anti-reflective coatings.

The locators 235 are objects located in specific positions on the HMD 205 relative to one another and relative to a specific reference point on the HMD 205. The locators 135 are an embodiment of the locators 235. A locator 235 may be a light emitting diode (LED), a corner cube reflector, a reflective marker, a type of light source that contrasts with an environment in which the HMD 205 operates, or some combination thereof. Active locators 235 (i.e., an LED or other type of light emitting device) may emit light in the visible band (~380 nm to 750 nm), in the infrared (IR) band (~440 nm to 1700 nm), in the ultraviolet band (10 nm to 380 nm), some other portion of the electromagnetic spectrum, or some combination thereof.

The locators 235 can be located beneath an outer surface of the HMD 205, which is transparent to the wavelengths of light emitted or reflected by the locators 235 or is thin enough not to substantially attenuate the wavelengths of light emitted or reflected by the locators 235. Further, the outer surface or other portions of the HMD 205 can be opaque in the visible band of wavelengths of light. Thus, the locators 235 may emit light in the IR band while under an outer surface of the HMD 205 that is transparent in the IR band but opaque in the visible band.

As described above with reference to FIG. 1, the IMU 130 is an electronic device that generates IMU data based on measurement signals received from one or more of the position sensors 125, which generate one or more measurement signals in response to motion of HMD 705. Examples of the position sensors 125 include accelerometers, gyroscopes, magnetometers, other sensors suitable for detecting motion, correcting error associated with the IMU 130, or some combination thereof.

Based on the measurement signals from the position sensors 125, the IMU 130 generates IMU data indicating an estimated position of the HMD 205 relative to an initial position of the HMD 205. For example, the position sensors 125 include multiple accelerometers to measure translational motion (forward/back, up/down, left/right) and multiple gyroscopes to measure rotational motion (e.g., pitch, yaw, and roll). The IMU 130 can, for example, rapidly sample the measurement signals and calculate the estimated position of the HMD 205 from the sampled data. For example, the IMU 130 integrates measurement signals received from the accelerometers over time to estimate a velocity vector and integrates the velocity vector over time to determine an estimated position of a reference point on the HMD 205. The reference point is a point that may be used to describe the position of the HMD 205. While the reference point may generally be defined as a point in space, in various embodiments, a reference point is defined as a point within the HMD 205 (e.g., a center of the IMU 130). Alternatively, the IMU 130 provides the sampled measurement signals to the console 225, which determines the IMU data.

The IMU 130 can additionally receive one or more calibration parameters from the console 225. As further discussed below, the one or more calibration parameters are used to maintain tracking of the HMD 205. Based on a received calibration parameter, the IMU 130 may adjust one or more of the IMU parameters (e.g., sample rate). In some embodiments, certain calibration parameters cause the IMU 130 to update an initial position of the reference point to correspond to a next calibrated position of the reference point. Updating the initial position of the reference point as the next calibrated position of the reference point helps reduce accumulated error associated with determining the estimated position. The accumulated error, also referred to as drift error, causes the estimated position of the reference point to "drift" away from the actual position of the reference point over time.

The eye tracking system 238 determines eye tracking information associated with one or both eyes of a user wearing the HMD 205. The eye tracking information determined by the eye tracking system 238 may comprise information about an orientation of the user's eye, i.e., information about an angle of an eye-gaze. The eye tracking system 238 includes a source assembly that illuminates one or both eyes of the user with a light pattern. A camera assembly captures images of the light pattern reflected by a portion of the eye(s) being tracked. At least one of the captured images includes a subset of the plurality of glints that are reflected by the boundary region. The eye tracking system 238 determines a position of the eye(s). The eye tracking system 238 then determines eye tracking information using the determined position(s). For example, given a position of an eye the eye tracking system 238 can determine a gaze angle.

In some embodiments, the varifocal module 240 is further integrated into the HMD 205. The varifocal module 240 may be coupled to the eye tracking system 238 to obtain eye tracking information determined by the eye tracking system 238. The varifocal module 240 may adjust focus of one or more images displayed on the electronic display 230, based on the determined eye tracking information obtained from the eye tracking system 238. In this way, the varifocal module 240 can mitigate vergence-accommodation conflict in relation to image light. The varifocal module 240 can be interfaced (e.g., either mechanically or electrically) with at least one of the electronic display 230 and at least one optical element of the optics block 232. Then, the varifocal module 240 may adjust focus of the one or more images displayed on the electronic display 230 by adjusting position of at least one of the electronic display 230 and the at least one optical element of the optics block 232, based on the determined eye tracking information obtained from the eye tracking system 238. By adjusting the position, the varifocal module 240 varies focus of image light output from the electronic display 230 towards the user's eye. The varifocal module 240 may also adjust resolution of the images displayed on the electronic display 230 by performing foveated rendering of the displayed images, based at least in part on the determined eye tracking information obtained from the eye tracking system 238. In this case, the varifocal module 240 provides appropriate image signals to the electronic display 230. The varifocal module 240 provides image signals with a maximum pixel density for the electronic display 230 only in a foveal region of the user's eye-gaze, while providing image signals with lower pixel densities in other regions of the electronic display 230.

The imaging device 210 generates image data in accordance with calibration parameters received from the console 225. Image data includes one or more images showing observed positions of the locators 235 that are detectable by imaging device 210. The imaging device 210 may include one or more cameras, one or more video cameras, other devices capable of capturing images including one or more locators 235, or some combination thereof. Additionally, the imaging device 210 may include one or more filters (e.g., for increasing signal to noise ratio). The imaging device 210 detects light emitted or reflected from the locators 235 in a field of view of the imaging device 210. In embodiments where the locators 235 include passive elements (e.g., a retroreflector), the imaging device 210 may include a light source that illuminates some or all of the locators 235, which retro-reflect the light towards the light source in the imaging device 210. Image data is communicated from the imaging device 210 to the console 225, and the imaging device 210 receives one or more calibration parameters from the console 225 to adjust one or more imaging parameters (e.g., focal length, focus, frame rate, ISO, sensor temperature, shutter speed, aperture, etc.).

The I/O interface 215 is a device that allows a user to send action requests to the console 225. An action request is a request to perform a particular action. For example, an action request may be to start or end an application or to perform a particular action within the application. The I/O interface 215 may include one or more input devices. Example input devices include a keyboard, a mouse, a game controller, or any other suitable device for receiving action requests and communicating the received action requests to the console 225. An action request received by the I/O interface 215 is communicated to the console 225, which performs an action corresponding to the action request. In some embodiments, the I/O interface 215 may provide haptic feedback to the user in accordance with instructions received from the console 225. For example, haptic feedback is provided by the I/O interface 215 when an action request is received, or the console 225 communicates instructions to the I/O interface 215 causing the I/O interface 215 to generate haptic feedback when the console 225 performs an action.

The console 225 provides content to the HMD 205 for presentation to the user in accordance with information received from the imaging device 210, the HMD 205, or the I/O interface 215. In the example shown in FIG. 2, the console 225 includes an application store 245, a tracking module 250, and an engine 260. Some embodiments of the console 225 have different or additional modules than those described in conjunction with FIG. 2. Similarly, the functions further described below may be distributed among components of the console 225 in a different manner than is described here.

The application store 245 stores one or more applications for execution by the console 225. An application is a group of instructions, that when executed by a processor, generates content for presentation to the user. Content generated by an application may be in response to inputs received from the user via movement of the HMD 205 or the I/O interface 215. Examples of applications include gaming applications, conferencing applications, video playback application, or other suitable applications.

The tracking module 250 calibrates the system 200 using one or more calibration parameters and may adjust one or more calibration parameters to reduce error in determining position of the HMD 205. For example, the tracking module 250 adjusts the focus of the imaging device 210 to obtain a more accurate position for observed locators 235 on the HMD 205. Moreover, calibration performed by the tracking module 250 also accounts for information received from the IMU 130. Additionally, if tracking of the HMD 205 is lost (e.g., imaging device 210 loses line of sight of at least a threshold number of locators 235), the tracking module 250 re-calibrates some or all of the system 200 components.

Additionally, the tracking module 250 tracks the movement of the HMD 205 using image information from the imaging device 210 and determines positions of a reference point on the HMD 205 using observed locators from the image information and a model of the HMD 205. The tracking module 250 also determines positions of the reference point on the HMD 205 using position information from the IMU information from the IMU 215 on the HMD 205. Additionally, the tracking module 250 may use portions of the IMU information, the image information, or some combination thereof, to predict a future location of the HMD 205, which is provided to the engine 260.

The engine 260 executes applications within the system 200 and receives position information, acceleration information, velocity information, predicted future positions, or some combination thereof for the HMD 205 from the tracking module 250. Based on the received information, the engine 260 determines content to provide to the HMD 205 for presentation to the user, such as a virtual scene, one or more virtual objects to overlay onto a real world scene, etc. Additionally, the engine 260 performs an action within an application executing on the console 225 in response to an action request received from the I/O interface 215 and provides feedback to the user that the action was performed.

The provided feedback may be visual or audible feedback via the HMD 205 or haptic feedback via VR I/O interface 215.

In some embodiments, based on the eye tracking information (e.g., orientation of the user's eye) received from the eye tracking system 238, the engine 260 determines resolution of the content provided to the HMD 205 for presentation to the user on the electronic display 230. The engine 260 provides the content to the HMD 205 having a maximum pixel resolution on the electronic display 230 in a foveal region of the user's gaze, whereas the engine 260 provides a lower pixel resolution in other regions of the electronic display 230, thus achieving less power consumption at the HMD 205 and saving computing cycles of the console 225 without compromising a visual experience of the user. In some embodiments, the engine 260 can further use the eye tracking information to adjust where objects are displayed on the electronic display 230 to prevent vergence-accommodation conflict.

Figure 3:
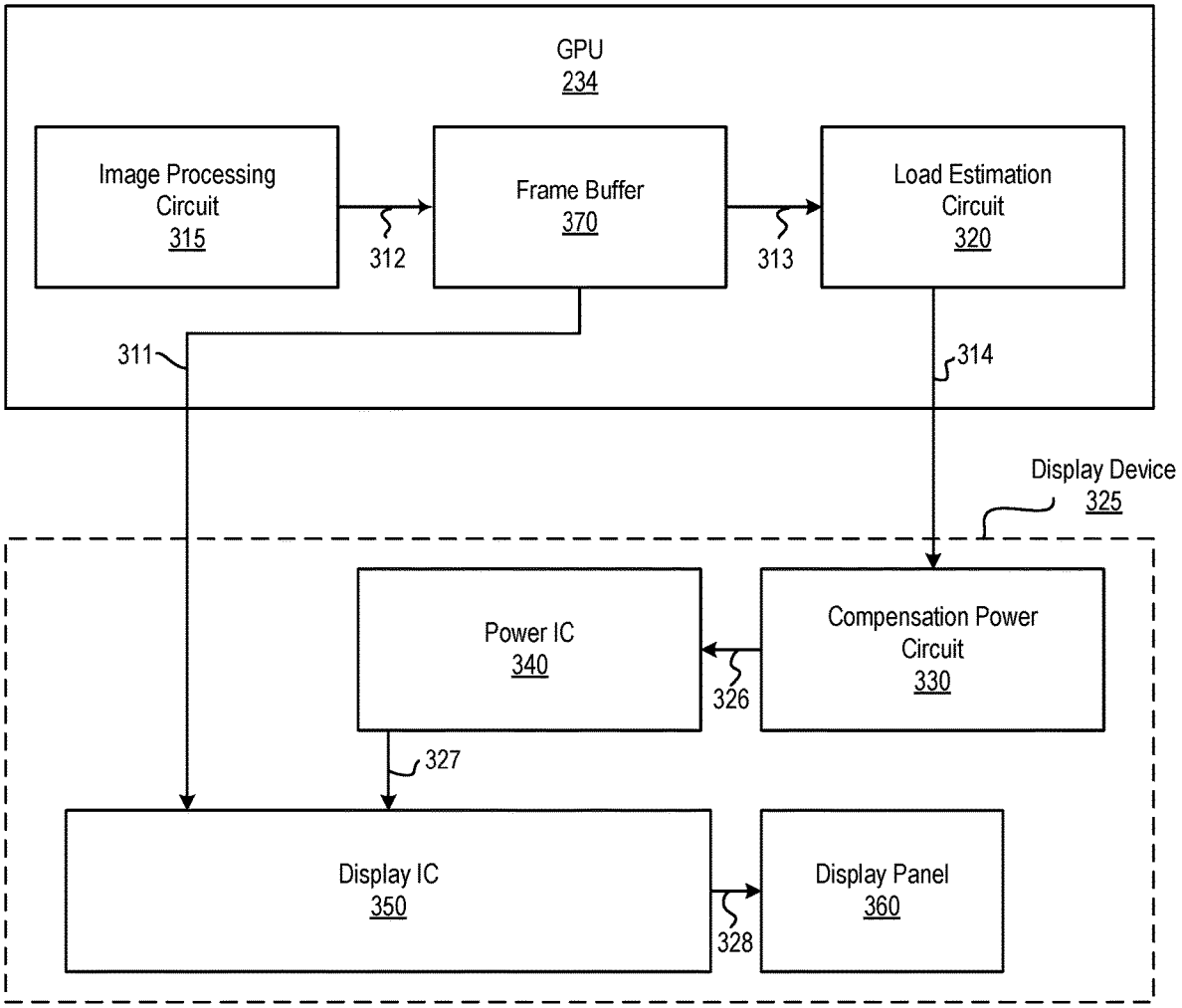
FIG. 3 is a diagram of a graphics processing unit (GPU) and display device of the HMD, in accordance with an embodiment.

FIG. 3 is a diagram illustrating a graphics processing unit (GPU) 234 and display device 325 of the HMD 100, in accordance with an embodiment. The graphics processing unit (GPU) 234 and a display device 325 operably coupled to the GPU 234 may be part of the HMD 100, as described above with reference to FIGS. 1 and 2.

The GPU 234 is a circuit that performs operation to efficiently generate images for output to the display device 325. The GPU 234 also generates and provides a load signal 314 indicating expected power consumption for displaying the images output to the display device 325. For this purpose, the GPU 234 may include, among other components, an image processing circuit 315, a frame buffer 370 and a load estimation circuit 320. The image processing circuit 315 includes circuit components (e.g., transistors) for performing at least one of asynchronous time warp (ATW) and asynchronous space warp (ASW) frame-rate smoothing techniques on image data received from CPU or system memory of HMD 100. The images processed by the image processing circuit 315 is stored in a buffer frame 312.

The load estimation circuit 320 is a circuit that generates a load signal 314 representing power estimated for displaying the processed images. The load estimation circuit 320 is coupled 313 to the frame buffer 370 to access the processed image stored in the frame buffer 370. The load estimation circuit 320 performs computation to estimate the power consumption for displaying the processed image by analyzing overall brightness of the pixels in the processed image and/or the dynamic change of pixel values in a current image relative to pixel values in a previous image.

The load signal 314 may be set at several levels decided in part by a requirement of a driver integrated circuit (IC) 350. In one embodiment, the load signal 314 indicates one of three values (e.g., high, middle, low) representing different levels of power estimates. That is, a load signal 314 set at a high level indicates heavy loading and a load signal set at a low level indicates light loading.

The display device 325 displays images 311 received from the GPU 234. For this purpose, the display device 325 may include, among other components, a power IC 340, a compensation power circuit 330, display IC 350, and a display panel 360. The display IC is 350 coupled 311 to the GPU 234 (e.g., image processing circuit 315 of the GPU 234) to receive the processed image. The display IC 350 generates signals for driving a display panel 360. The signals for driving the display panel 360 include, for example, gate driving signals for turning on or off thin film transistors (TFT) in pixels of the display panel 360 and data line signals for controlling brightness of the pixels.

The compensation power circuit 330 generates a control signal 326 to adjust the input voltage to the display IC 350 to account for a voltage drop between the power IC 340 and the display IC 350 based on the load signal 314 from the load estimation circuit 320 of the GPU 234. The compensation power circuit 330 increases its output voltage so that the input voltage to the display IC 350 is increased when current between the power IC 340 and display IC 350 is increased (i.e., the load signal 314 indicates a high value), and decreases its output voltage so that the input voltage to the display IC 350 is increased when the current between the power IC 340 and display IC 350 is decreased (i.e., the load signal 314 indicates a low value). In this way, the input voltage at the display IC 350 is maintained relatively constant even when the current load of the display IC 350 fluctuates.

The power IC 340 is coupled to the display IC 350 to control an input voltage to the display IC 350. The power IC 340 may include a voltage regulator to provide a desired output voltage at its output.

For example, in a conventional HMD system, the power IC 340 provides a static voltage input of 1.8V to the display IC 350. Suppose the wire 327 coupling the power IC 340 and the display IC 350 has an electrical resistance of 0.5 Ohms. As images displayed on the display device 325 changes from light current load to heavy current load, the current between the power IC 340 and the display IC 350 for displaying the images increases from 100 mA to 800 mA. Consequently, the voltage input to the display IC 350 decreases from 1.75V to 1.4V. Assuming that the display IC 350 requires input voltage of 1.8V±0.3V to properly operate, the drop in the voltage input to the display IC 350 is insufficient to properly drive the display panel 360.

In contrast, the HMD system of the present disclosure calculates the current load for display images on the display device 325 in the load estimation circuit 320 of the GPU 234 and generates the load signal 314 indicating one of three values (e.g., high, medium, low) representing different power estimates to the compensation power circuit 330 of power IC 340. The compensation power circuit 330 then sends the control signal 326 to cause the power IC 340 to dynamically change the input voltage to the display IC 350. For example, as the images for displaying on the display device 325 changes from light current load to heavy current load, the load estimation circuit 320 changes the output voltage of the power IC 340 from 1.85V to 2.2V, so the input value into the display IC 350 remains at 1.8V (assuming the same resistance of the wire 327 and the current consumption as in the example of the conventional HMD system).

In some embodiments, the power compensation circuit 330 is a part of the power IC 340. In alternative embodiments, the power compensation circuit 330 is separate from the power IC 340. Moreover, one or more of the power compensation circuit 330 and the power IC 340 may be provided at the GPU 234 instead of the display device 325.

The display panel 360 may be one of a light-emitting diode display (LED), a plasma display (PDP), a liquid crystal display (LCD), and an organic light-emitting diode display (OLED). The display panel 360 is an embodiment of the electronic display 230 of FIG. 2.

Example Method of Computing Load for Displaying an Image

Figure 4:
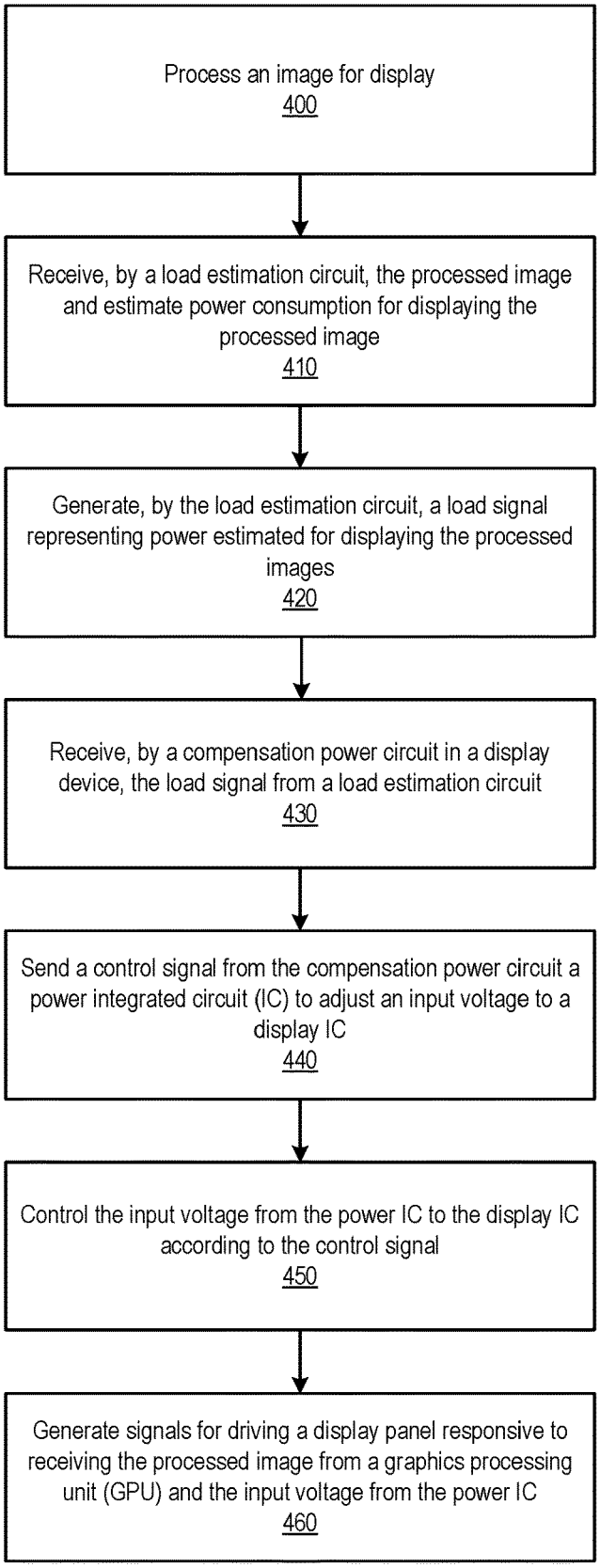
FIG. 4 is a flowchart illustrating a method of operating a display device of a HMD, in accordance with an embodiment.

FIG. 4 is a flowchart illustrating a method of computing load for displaying an image on the display device 325 of a HMD, in accordance with an embodiment. An image processing circuit processes 400 an image for display. Processing an image for display includes utilizing at least one of asynchronous time warp (ATW) and asynchronous space warp (ASW) frame-rate smoothing techniques.

A load estimation circuit receives 410 the processed image and estimates power consumption for displaying the processed image.

The load estimation circuit generates 420 a load signal representing power estimated for displaying the processed image. The load signal may indicate one of three values representing different power estimates.

A compensation power circuit in a display device receives 430 the load signal generated by the load estimation circuit.

The compensation power circuit sends 440 a control signal to a power integrated circuit (IC) to adjust an input voltage to a display IC to account for a voltage drop between the power IC and the display IC based on the load signal.

The power IC controls 450 the input voltage to the display IC according to the control signal. The power IC increases or decreases its output voltage so that the input voltage to the display IC remains relatively constant even if current between the power IC and the display IC is increased or decreased.

The display IC generates 460 signals for driving a display panel responsive to receiving the processed image from a graphics processing unit (GPU) and the input voltage from the power IC.

The foregoing description of the embodiments has been presented for the purpose of illustration; it is not intended to be exhaustive or to limit the patent rights to the precise forms disclosed. Many modifications and variations are possible in light of the above disclosure.

The language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A system comprising:

a graphics processing unit (GPU) comprising:

an image processing circuit configured to process images for display, and a load estimation circuit configured to receive the processed image and estimate power consumption for displaying the processed image, the load estimation circuit further configured to generate and send a load signal representing power estimated for displaying the processed images; and a display device operably coupled to the GPU, the display device comprising:

a display integrated circuit (IC) configured to receive the processed image from the GPU and generate signals for driving a display panel, a power IC configured to control input voltage at the display IC, and a compensation circuit configured to receive the load signal from the load estimation circuit and send a control signal to the power IC to increase the input voltage to the display IC responsive to an increase in current between the power IC and the display IC as indicated by the load signal, and decrease the input voltage to the display IC responsive to a decrease in the current as indicated by the load signal.

2. The system of claim 1, wherein the GPU further includes a frame buffer coupled to the image processing circuit to receive and store the processed image, the load estimation circuit coupled to the frame buffer to access the processed image stored in the frame buffer.

3. The system of claim 1, wherein the image processing circuit utilizes at least one of: asynchronous time warp (ATW) and asynchronous space warp (ASW) frame-rate smoothing techniques.

4. The system of claim 1, wherein the load signal indicates one of three values representing different power estimates.

5. The system of claim 1, wherein the display panel is at least one of: a light-emitting diode display (LED), a plasma display panel (PDP), a liquid crystal display (LCD), and an organic light-emitting diode display (OLED).

6. A method comprising:

processing an image for display;

receiving, by a load estimation circuit of a graphics processing unit (GPU), the processed image and estimating power consumption for displaying the processed image;

generating, by the load estimation circuit, a load signal representing power estimated for displaying the processed image;

receiving, by a compensation power circuit in a display device, the load signal generated by the load estimation circuit;

sending a control signal from the compensation power circuit to a power integrated circuit (IC) to increase an input voltage to the display IC responsive to an increase in current between the power IC and the display IC as indicated by the load signal, and decrease the input voltage to the display IC responsive to a decrease in the current as indicated by the load signal;

controlling the input voltage from the power IC to the display IC according to the control signal; and generating at the display IC signals for driving a display panel responsive to receiving the processed image from the GPU and the input voltage from the power IC.

7. The method of claim 6 further comprising:

storing the processed image in a frame buffer coupled to an image processing circuit, the load estimation circuit and the display IC receiving the processed image from the frame buffer.

8. The method of claim 6, wherein processing an image for display further comprises:

utilizing at least one of asynchronous time warp (ATW) and asynchronous space warp (ASW) frame-rate smoothing techniques.

9. The method of claim 6, wherein the load signal indicates one of three values representing different power estimates.

10. The method of claim 6, wherein the display panel is at least one of: a light-emitting diode display (LED), a plasma display panel (PDP), a liquid crystal display (LCD), and an organic light-emitting diode display (OLED).

11. A head mounted display (HMD) comprising:

a graphics processing unit (GPU) comprising:

an image processing circuit configured to process images for display, and a load estimation circuit configured to receive the processed image and estimate power consumption for displaying the processed image, the load estimation circuit further configured to generate and send a load signal representing power estimated for displaying the processed images; and a display device operably coupled to the GPU, the display device comprising:

a display integrated circuit (IC) configured to receive the processed image from the GPU and generate signals for driving a display panel, a power integrated circuit (IC) configured to control input voltage to the display IC, and a compensation circuit configured to receive the load signal from the load estimation circuit and send a control signal to increase the input voltage to the display IC responsive to an increase in current between the power IC and the display IC as indicated by the load signal, and decrease the input voltage to the display IC responsive to a decrease in the current as indicated by the load signal.

12. The HMD of claim 11, wherein the GPU further includes a frame buffer coupled to the image processing circuit to receive and store the processed image, the load estimation circuit coupled to the frame buffer to access the processed image stored in the frame buffer.

13. The HMD of claim 11, wherein the image processing circuit utilizes at least one of: asynchronous time warp (ATW) and asynchronous space warp (ASW) frame-rate smoothing techniques.

14. The HMD of claim 11, wherein the load signal indicates one of three values representing different power estimates.

* * * * *